US009774964B2

(12) United States Patent
Karamuk et al.

(10) Patent No.: US 9,774,964 B2
(45) Date of Patent: Sep. 26, 2017

(54) PIM HOUSING

(75) Inventors: Erdal Karamuk, Mannedorf (CH); David Waeckerlin, Stafa (CH); Pascal Kunzi, Schonenberg (CH)

(73) Assignee: SONOVA AG, Staefa (CH)

( * ) Notice: Subject to any disclaimer, the term of this patent is extended or adjusted under 35 U.S.C. 154(b) by 406 days.

(21) Appl. No.: 13/994,894

(22) PCT Filed: Dec. 28, 2010

(86) PCT No.: PCT/EP2010/070783
§ 371 (c)(1),
(2), (4) Date: Jun. 17, 2013

(87) PCT Pub. No.: WO2011/033135
PCT Pub. Date: Mar. 24, 2011

(65) Prior Publication Data

US 2013/0266167 A1 Oct. 10, 2013

(51) Int. Cl.

| | |
|---|---|
| ***H04R 25/00*** | (2006.01) |
| ***B22F 7/06*** | (2006.01) |
| ***B22F 3/24*** | (2006.01) |
| ***B22F 3/22*** | (2006.01) |

(52) U.S. Cl.
CPC ..... *H04R 25/658* (2013.01); *B22F 3/225* (2013.01); *B22F 3/24* (2013.01); *B22F 7/062* (2013.01); *B22F 2003/242* (2013.01); *H04R 25/65* (2013.01); *Y10T 29/49002* (2015.01)

(58) Field of Classification Search
None
See application file for complete search history.

(56) References Cited

U.S. PATENT DOCUMENTS

| | | | | |
|---|---|---|---|---|
| 4,831,655 | A * | 5/1989 | Buettner | 381/322 |
| 4,962,537 | A * | 10/1990 | Basel et al. | 381/324 |
| 6,522,764 | B1 * | 2/2003 | Bøgeskov-Jensen | 381/330 |
| 6,762,375 | B2 | 7/2004 | Haussmann | |
| 6,843,690 | B2 * | 1/2005 | Sauer et al. | 439/722 |
| 7,003,127 | B1 * | 2/2006 | Sjursen et al. | 381/322 |
| 7,039,209 | B2 * | 5/2006 | Schmitt | 381/322 |
| 7,123,733 | B1 * | 10/2006 | Borowsky et al. | 381/322 |
| 8,213,655 | B2 * | 7/2012 | Kral et al. | 381/322 |
| 8,254,608 | B2 * | 8/2012 | De Finis et al. | 381/322 |

(Continued)

FOREIGN PATENT DOCUMENTS

| | | |
|---|---|---|
| DE | 10 2006 062 423 A1 | 7/2008 |
| EP | 1 988 744 A1 | 11/2008 |
| WO | 2009/138524 A2 | 11/2009 |

OTHER PUBLICATIONS

International Search Report for PCT/EP2010/070783 dated Aug. 29, 2011.
Written Opinion for PCT/EP2010/070783 dated Aug. 29, 2011.

*Primary Examiner* — Curtis Kuntz
*Assistant Examiner* — Qin Zhu
(74) *Attorney, Agent, or Firm* — Pearne & Gordon LLP

(57) ABSTRACT

In a process for producing a hearing aid, comprising a housing made out, at least partially, of a metallic or ceramic part using powder injection molding technique (PIM) within the housing (1) at least one additional element (3) made out of a polymeric material is arranged for placing functional parts (5, 7, 13) within or at the housing (1) to reduce complexity of P parts and/or to compensate any tolerances due to the PIM process.

17 Claims, 4 Drawing Sheets

(56) References Cited

U.S. PATENT DOCUMENTS

Figure 1:
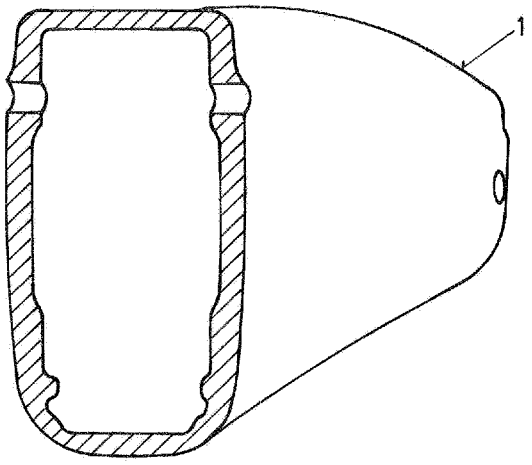

| | | | | |
|---|---|---|---|---|
| 2004/0081573 | A1* | 4/2004 | Newell | 419/10 |
| 2007/0047752 | A1* | 3/2007 | Wagner et al. | 381/330 |
| 2008/0013765 | A1* | 1/2008 | Nielsen et al. | 381/322 |
| 2008/0044049 | A1* | 2/2008 | Ho et al. | 381/323 |
| 2008/0124981 | A1* | 5/2008 | Jorgensen et al. | 439/660 |
| 2008/0273732 | A1* | 11/2008 | Fickweiler et al. | 381/330 |
| 2009/0136069 | A1* | 5/2009 | Heerlein et al. | 381/323 |
| 2009/0252359 | A1* | 10/2009 | Ho et al. | 381/323 |
| 2010/0226518 | A1* | 9/2010 | Severin | 381/322 |
| 2010/0322452 | A1* | 12/2010 | Ladabaum et al. | 381/375 |
| 2011/0002491 | A1* | 1/2011 | Klemenz et al. | 381/322 |
| 2011/0262740 | A1* | 10/2011 | Martin et al. | 428/332 |
| 2011/0268302 | A1* | 11/2011 | Lim et al. | 381/322 |

* cited by examiner

PIM HOUSING

The present invention refers to a process for producing a hearing aid comprising a housing made out of at least partially of a metallic or ceramic part according to the introduction of claim 1 and further to a hearing aid comprising at least two metallic or ceramic parts made using PIM technique.

Today hearing aid housings are almost exclusively made of plastic materials. In order to obtain product differentiation and high value appeal, various methods and technologies are being used.

Coloring of plastic resins by means of color pigments or application of color lacquers to the plastic housing are the most commonly applied methods.

E.g. the following techniques can also be used for product differentiation, water transfer printing, hot embossing, galvanisation (possible for a limited selection of plastics), surface structuring with laser, pad printing, in mold decoration (IMD), film insert molding (FIM), application of adhesive foils or stickers, 3D-sublimation printing.

To obtain a real metal surface finish featuring a high-tech appearance and exclusivity, plasma vapour deposition (PVD) coatings can be applied. However, such layers are very thin and usually need to be protected with a topcoat for environmental resistance. Due to the limited thickness of the metal layer, the part will also not feel like metal upon contact with the skin. The low thermal conductivity of plastic will always be dominating.

Another method to achieve a real metal surface is the film back injection molding of relatively thick metal foils (>50 um), resulting in a polymer metal composite. This is described in WO 2008/015296 A2. With this method, a "cool touch effect", similar to full metal parts, can be obtained. However, the achievable deformation of the metal foil is limited to relatively large radii and complex shapes are not possible.

A ceramic-like appearance could be obtained by using hydrocarbon based coatings, such as plasma assisted diamond like carbon (DLC) depositions which can be applied at moderate temperatures on some plastics. Though, such coatings will also suffer from a plastic touch-and-feel since the thickness is in the range of a few microns only.

Other than that, functional metal coatings are also known in the hearing aid industry. These are mainly used for high frequency radiation shielding and are commonly applied on the interior side of housing parts, which means such coatings are clearly not meant for decorative purposes.

To obtain a considerably higher and more exclusive value appeal compared to the above mentioned examples, the hearing aid housing should be made completely of a metallic or ceramic material (solid metal or ceramic part). In addition, the overall hearing aid appearance should be dominated by the metal or ceramic material, which means that not only a small portion of the housing is made of the respective material but the housing is made to a large extent of metal or ceramic.

Three dimensional metal or ceramic parts are traditionally manufactured by machining. This allows for very tight tolerances but is very limited in terms of part complexity for small parts with complicated structures at the inner surfaces. In addition, the high cost of this manufacturing method is usually not acceptable for a hearing aid housing to be produced in high volumes.

E.g. one example of a hearing aid housing completely made of metal (titanium) is described within the WO 0045617 A2. It contains threads and o-rings and is obviously to be produced by means of machining. The high mechanical strength and the shielding properties are given as motivation for the use of a metal housing.

Another possibility to manufacture complex metal or ceramic parts could be the powder injection molding (PIM) technology. This is more cost effective for higher numbers and more complex three dimensional shapes than with machining can be achieved.

Metal injection molding (MIM) and ceramic injection molding (CIM), generally referred to as PIM, basically include the following process steps:

- Preparation of feedstock (plastic resin highly filled with well defined metal or ceramic powder).
- Injection molding process. This is very similar to plastic injection molding. However, different tooling materials have to be used due to the highly abrasive properties of the feedstock. The molded part is called "green part" and is very fragile. In some cases, subsequent machining can be done in this stage already.
- De-bindering process (thermally or chemically). In this step, the plastic binder is removed from the part. The part is now called "brown part".
- Sintering process. The part is heated in a sintering furnace below its melting point until the powder particles adhere to each other. In this process, the part shrinks by around 20% to 30%.
- Finishing processes, such as machining, polishing and labelling (e.g. laser engraving) are done in the sintered state.

Parts produced in a PIM process have already been disclosed in the context of hearing aids:

E.g. the DE 10 2006 062 423 A1 discloses a hearing instrument with a housing and a sound conducting part in or attached to the housing. At least a part of the housing and/or the sound conducting part is made of an injection molded ceramic material. There is no reference however of how to design a hearing aid housing made with PIM technology dealing with the material characteristics and the limitations of the manufacturing process.

The EP 1 988 744 A1 describes a connecting element to connect a sound hook to a hearing aid. The connecting element is a powder injection molded part (metal or ceramic). The use of powder injection molding is clearly motivated by the high mechanical strength of metallic or ceramic materials. No details are given of how to design a hearing aid housing produced in powder injection molding.

According to the WO 05/062668 A1 a BTE housing can be formed of a metallic material, a ceramic material, a polymeric material, or some combination thereof. Only a general statement in the description about different materials is given, which can be used for a hearing aid housing. No details are given of how a metallic or ceramic housing would be mechanically designed.

Metallic or ceramic housings are also used in other industries, such as communication devices and computer devices. An example is described within the U.S. Pat. No. 7,724,532, where a portable computing device with a radio transparent housing is made of ceramic.

The use of metal (e.g. steel or titanium) or ceramic (e.g. Zirconium Oxide, Aluminium Oxide, Silicon Nitride) materials for a hearing aid housing is motivated by the search for materials that have a high-tech appeal for value differentiation as well as objective benefits such as superior biocompatibility and high environmental resistance compared to the classic polymeric materials (e.g. ABS, ABS-PC or Nylon) in their various colour and surface finishes.

In order to preserve the high value appeal, the hearing aid housing is preferably made to a large extent of the respective metal or ceramic material. If only a small portion of the housing is made of metal or ceramic, this would considerably reduce the subjective value appearance of the device.

A hearing aid has very specific requirements. Miniaturization, functionality and reliability make high demands on housing parts and materials. With the known typical hearing aid designs, the housing parts need to meet very tight tolerances to ensure highly integrated functionality, reliable performance, acoustical stability and also environmental resistance of the device. Furthermore, the housing parts have to be biocompatible for prolonged skin contact. For hearing aids with wireless communication interfaces, the housing has to be radio transparent as well.

Hence, designing a hearing aid housing which is, to a large extent, made out of a ceramic or metallic material, is very challenging and specific design solutions have to be found. For economical reasons the only way to produce such parts is with means of a powder injection molding (PIM) process. This manufacturing process allows a higher design freedom than machining or press forming. However, compared to plastic injection molding, the freedom of design is considerably reduced. E.g., minimum wall thicknesses are limited, wall thickness transitions have to be smooth, forced demolding is not possible, aspect ratios are limited.

The high shrinkage of the parts during the sintering process (20% to 30%) results in significant limitations regarding dimensional accuracy. The dimensional tolerance range for hearing aid housing parts produced in plastic injection molding is normally three to ten times more accurate than similar parts made in a PIM process. Larger gaps between the housing parts can therefore not be avoided without time consuming and expensive mechanical reworking after sintering which is therefore not considered.

Another important difference between ceramic/metal and plastic materials is the much higher stiffness and lower deformability. Plastic parts always show relaxation to some extent allowing a mechanical design with pre-stressed parts in an assembled device. This is not possible with ceramic or metallic parts adjoining to each other.

The limited design freedom, wider tolerances and non relaxing characteristics of hearing aid housing parts produced in a PIM process call for different mechanical design approaches taking into account these drawbacks.

It is therefore an object of the present invention to describe a solution of how to design a hearing aid housing with high value appeal and whose appearance is dominated by real metallic and/or ceramic materials, which are produced in a powder injection molding (PIM) process.

It is a further object to disclose how the specific requirements for a hearing aid can be fulfilled considering the material characteristics of metal and ceramic and taking into account the limitations caused by the powder injection molding process.

As a consequence, a process for producing a hearing aid, comprising a housing made out of at least partially of a metallic or ceramic part using powder injection molding technique according to the wording of claim 1, is proposed.

By producing a housing of a hearing aid it is proposed that within the housing at least one additional element made out of a polymeric material is arranged for placing any functional parts within or at the housing of the hearing aid to reduce complexity of the PIM parts and/or to compensate any tolerances due to the PIM process. These functional parts could be e.g. electronic components such as e.g. a receiver, an integrated circuit, a microphone, user control elements etc.

To combine the characteristics of ceramic or metal housing parts made in a PIM process with the requirements of a hearing aid, further specific solutions are proposed in further embodiments of the inventive process.

According to one embodiment, it is proposed that at least the main part of the housing design is made with a tubular cross section.

Again, according to a further embodiment, it is proposed that electronic parts are placed within the housing using a separate frame made out of a polymeric material.

Again, a further embodiment is proposing that supplementary parts, such as a microphone protection and/or sound port, user control elements, etc. are carried by the additional element and/or a further additional element made out of a polymeric material.

As polymeric materials any kind of suitable polymeric materials, usually used within the hearing aid industry, are appropriate, preferably thermoplastic and/or elastomeric polymers are used, which are e.g. resistant against perspiration.

According to a further embodiment of the inventive process, it is proposed that for assembling the hearing aid or hearing aid housing fastening elements like pins, cones, snap-fit elements, etc. are used together with respective counterparts for the fixation of the fastening elements, which are preferably made out of a polymeric material.

Further, it is proposed that at least two ceramic or metallic parts are used for the housing of the hearing aid, wherein an intermediate part made out of a polymeric material, such as e.g. an elastomeric material like rubber or the like, is used to ensure a stress free connection between the at least two parts. Further, embodiments of the inventive process are described within the dependent claims.

Further, a hearing aid comprising at least two metallic or ceramic parts is proposed according to the wording of claim 13. The at least two metallic or ceramic parts are made using PIM technique, wherein at least one additional element is arranged within the housing for placing functional parts to reduce complexity of PIM parts and/or to compensate any tolerances due to the PIM process.

According to one embodiment, the PIM parts are relatively movable against each other.

Again, further embodiments of the inventive hearing aid housing are described within further dependent claims.

The invention is further described by way of examples and with reference to the attached figures.

WITHIN THE FIGURES

Figure 2:
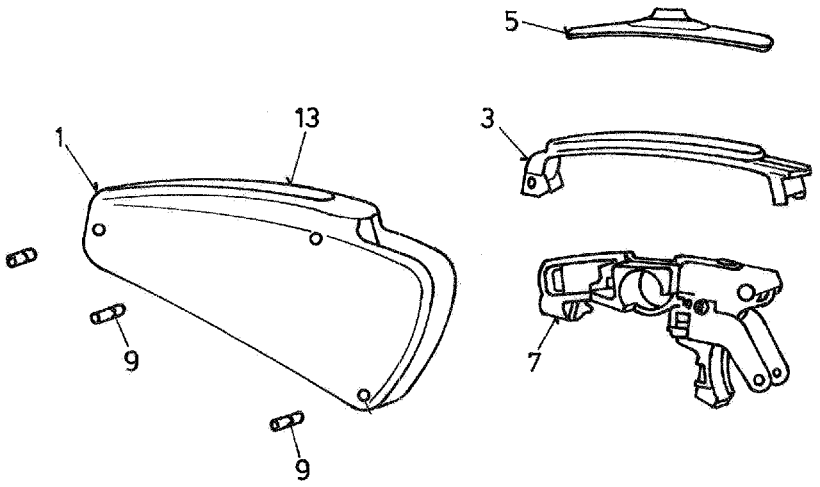
Figure 3:
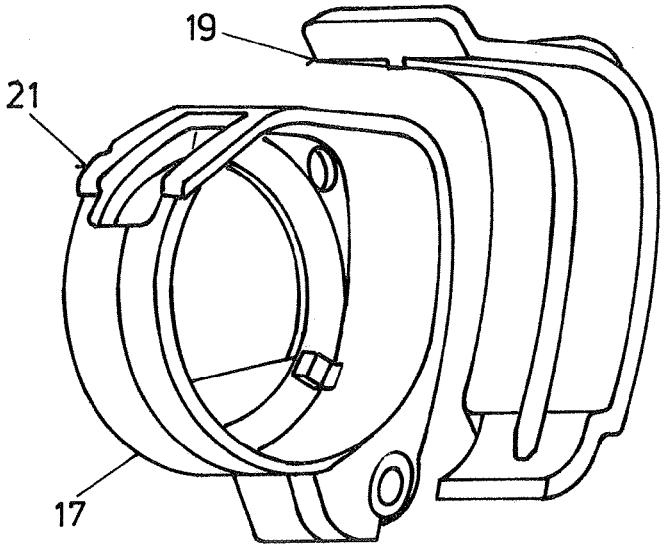
Figure 4:
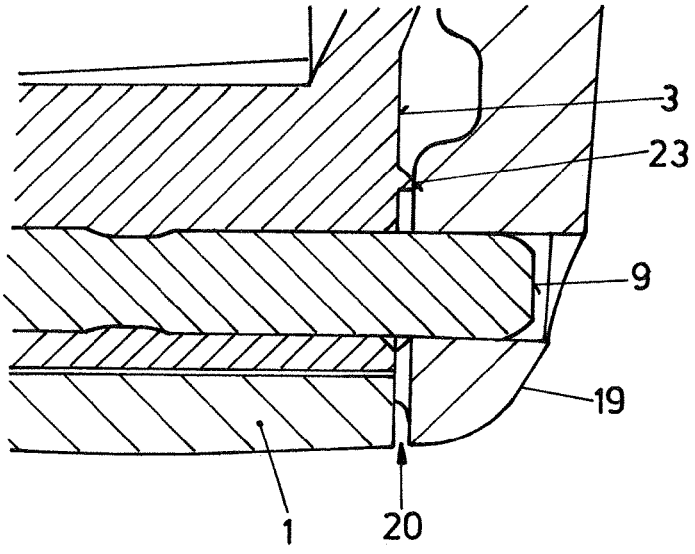
Figure 5:
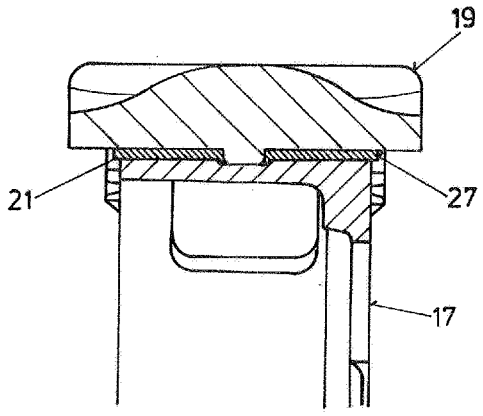
Figure 6:
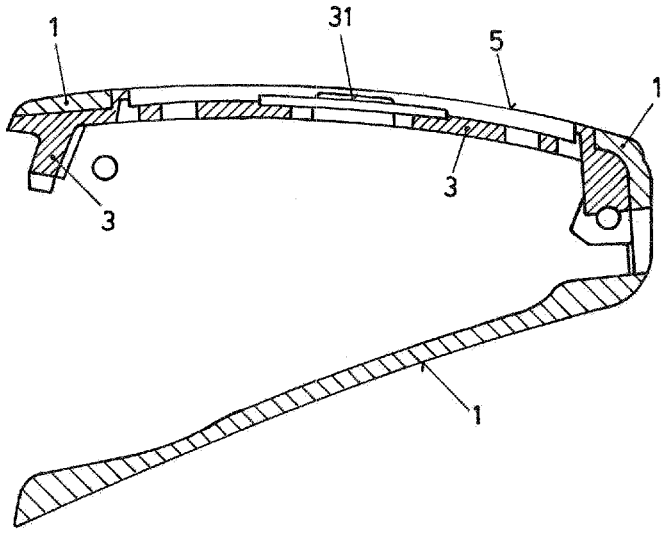
Figure 7:
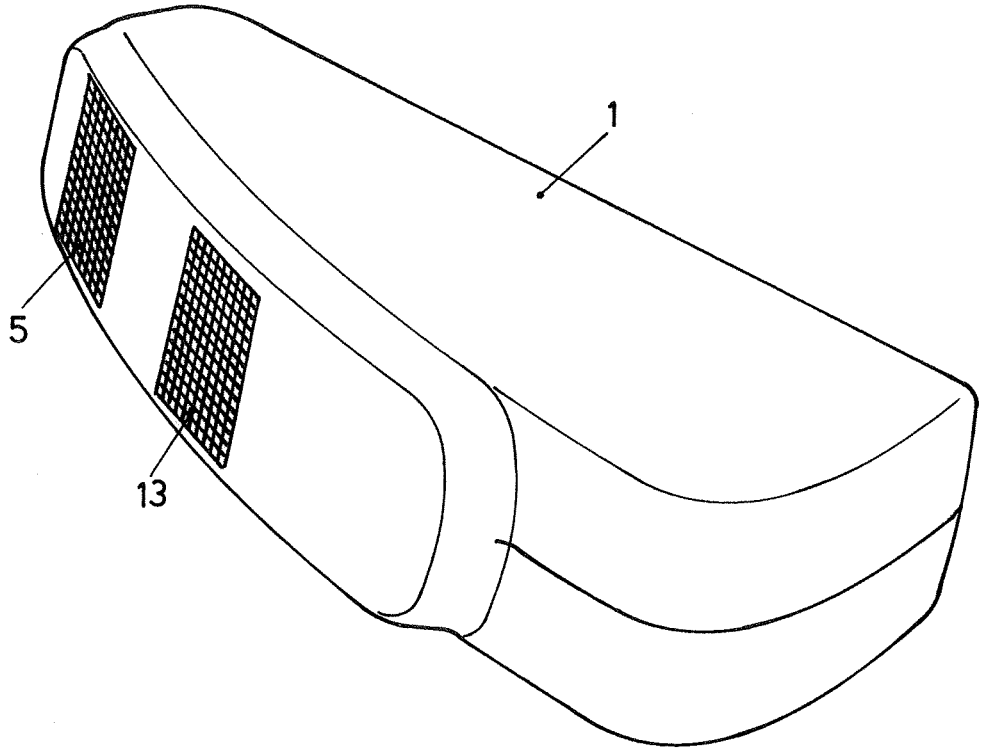

FIG. 1 shows in perspective and cut cross sectional view of a tubular design of a hearing aid housing, FIG. 2 in perspective view a hearing aid housing with functional elements to be placed within the housing according to the present invention, FIG. 3 the battery door in perspective view with a PIM made part connected to a polymeric part, FIG. 4 in cross sectional view, a part of the hearing aid assembly with so called compression ribs, FIG. 5 in top view on a battery door showing the adhesive bonding, FIG. 6 in cross sectional view the polymeric element according to the present invention with an integrated spring, and FIG. 7 in top view a hearing aid housing with integrated microphone protection and sound port.

Due to the small size of a hearing aid in general, the wall thickness of a housing has to be as thin as possible. When using a material with a relatively low breaking elongation, such as sintered ceramic or metal, the structure of the part itself has to be rigid, since increasing the wall thickness is usually not possible due to the space and size limitations. Therefore, a housing design 1 with a tubular cross section as shown in FIG. 1 is an appropriate solution to get a rigid structure.

Parts produced with PIM technology suffer from relatively large tolerances when compared to parts produced in plastic injection molding. Furthermore, the achievable complexity of PIM parts is considerably limited. In particular, ceramic parts do not allow delicate structures, because of material cracking risk. The approach to overcome these limitations is the use of specifically designed plastic parts in combination with the metal or ceramic parts.

In the hearing aid housing 1, as shown in FIG. 2, it is necessary to place the electronic components in an accurately defined position. Due to the above mentioned limitations, this is hardly possible with a PIM part. This can be solved by placing the electronic components in a separate frame 7, preferably made of a plastic material for a more accurate positioning. The frame can also compensate tolerances and allows certain absorption of accelerating forces in case the device is dropped accidentally by the user. An additional plastic part 3 inside or mounted to the PIM housing parts can be used to carry supplementary parts such as a microphone protection and/or sound port 5/13 or user control elements such as e.g. a program switch or volume control.

To assemble the hearing aid, fastening elements like pins 9, cones or snap-fit elements are required. The large tolerances and low ductility of PIM materials, except some metals, do not allow the realization of press-fit or snap-fit connections. Therefore, a polymeric counterpart for the fixation of the fastening element is necessary.

In case the hearing aid housing consists of more than two ceramic parts, such as e.g. a housing comprising two half-shells, direct contact between the two parts is critical because of the possibility of pre-stressed assembly due to no relaxation of the material. This can result in crack formation during usage of the device. Furthermore, a tight sealing of the contact surface between ceramic housing parts is hardly feasible. An intermediate part made of plastic or rubber can secure a close and stress free connection between two ceramic housing parts.

Metal injection molded parts are conductive and therefore need to be separated from the electronic components, wires and battery contacts as well as the battery itself by using lacquer, coating or another non-conductive encapsulation part.

The typical mechanical solution for hearing aids to lock the battery door is realized by designing a snap-fit element into the battery door that can engage in a counterpart in the main housing of the hearing aid or the internal electronic module. This function cannot be realized with ceramic or metal parts due to the significantly higher stiffness and low ductility of these materials. To still realize a snap-fit battery door containing a ceramic or metal part, a counterpart 17 made of plastic with integrated snap and fit element 21, as shown in FIG. 3, can be integrated into the battery door and/or the housing parts and/or the internal electronic module. This counterpart 17 can be connected to the PIM part 19 by a fastening element, snap-fit, adhesive bonding, welding or press-fit.

As a result of the large tolerance range of PIM parts, compared to injection molded plastic parts, wide gaps 20 between the housing parts 1 and 19 can occur as shown in FIG. 4. In most cases it is necessary to reduce or compensate to some extent these gaps for technical reasons in order to prevent, e.g. acoustical instability, reliability or assembling issues.

To ensure a connection between a PIM part 1 and a plastic part 3 free from float, compression ribs 23 can be added to the plastic part. These compression ribs allow to be deformed during assembling with a small amount of force. The deformed compression ribs will adjust and fasten the distance between the assembled parts as shown in FIG. 4.

To fill tolerance related gaps and connect a PIM part to a plastic part or a second PIM part, adhesive bonding can be used as shown in principal in FIG. 5. The adhesive connection can be designed to compensate the occurring dimension differences with a variable adhesive gap 27. It is also possible using an adhesive to seal already connected parts.

If adhesive bonding is used to connect PIM parts to other PIM or polymeric parts, the PIM part can be subjected to a laser treatment prior to the bonding in order to increase surface roughness and thus improving the strength of the adhesive bond.

A further solution to compensate the larger tolerance range with PIM parts is to use a plastic part 3 with an elastic structure 31. The plastic part 3 is designed with an integral hinge or spring 31 and adapts to the ceramic or metal part without being irreversibly deformed.

It is possible to reduce the number of parts by directly integrating the microphone protection and/or sound port into a ceramic or metal housing part, as shown in FIG. 7. The typical microphone openings are very small and split up in several holes or grooves. Only simple openings can be integrated directly into the part during the PIM forming process. More complex and very fine openings can be integrated after the PIM process by laser or conventional milling and drilling.

A further requirement for hearing aid devices is the environmental resistance over long periods of time. Especially the highly corrosive human sweat is known to severely affect the hearing aid function once it reached the inside of the housing getting in contact with the sensitive electronic components. Also, hearing aid batteries are attacked resulting in corrosion of the battery and soiled battery compartment. Ceramic and metals both are materials with high surface energies compared to plastics. This leads to a different wetting behaviour: high energy liquids, such as water or sweat, will readily wet metal and ceramic. This problem can be solved with the deposition of a hydrophobic coating. Such a treatment will alter the surface energy considerably, thereby changing the wetting characteristics of the underlying metal or ceramic completely. The general coating requirements are a contact angle with water of higher than 90° (preferably higher than) 95°, resistance against mechanical abrasion, resistance against environmental influences such as low pH (sweat), fatty substances (skin, sun-cream), UV light exposure and alcoholic cleaning agents. For highly polished metal or ceramic parts, the coating has to be very thin (<50 nm, preferably <30 nm).

Silicon or fluorine based chemistries are possible for hydrophobic coatings on metal or ceramic parts. The coating process can be a gas phase process (with or without plasma), or liquid based coating (spraying, dipping, brushing). If ceramic or metal parts previously joined to plastic parts have to be coated, the process temperature should not exceed the glass transition point of the respective polymer material.

Moreover, the coating should be biocompatible for long term skin contact (non toxic, non irritating, non sensitizing).

Further, a hearing aid housing is required to feature some kind of labelling for identification of brand and product name. Ceramic or metal housings can be labelled with different techniques, such as pad printing and laser engraving. In order to emphasize the high value appeal, laser structuring is the preferred method. This method can also be used for serialization purposes.

The present invention is not at all limited to the shown examples within the figures and the respective above description. The basic idea of the figures is to give a better understanding of the present invention. According to the present invention, it becomes possible to produce hearing aids and in particular hearing aid housing with metallic and/or ceramic appearance by using PIM technique in an easy and costly manner, nevertheless taking the high quality requirements of a hearing aid into consideration.

The invention claimed is:

1. A process for producing a hearing aid, comprising a housing made out, at least partially, of a metallic or ceramic part using powder injection molding technique (PIM), wherein within the housing at least one additional element made out of a polymer material is arranged for placing functional parts within or at the housing to reduce complexity of PIM parts and/or to compensate any tolerances due to the PIM process, wherein at least a main part of the housing design is made with an integral tubular cross section, wherein at least two ceramic or metal parts are used for the housing of the hearing aid, and wherein the hearing aid comprises at least one intermediate part made out of a polymeric material to ensure a stress free connection between the at least two parts.

2. A process for producing a hearing aid, comprising a housing made out, at least partially, of a metallic or ceramic part using powder injection molding technique (PIM), wherein within the housing at least one additional element made out of a polymer material is arranged for placing functional parts within or at the housing to reduce complexity of PIM parts and/or to compensate any tolerances due to the PIM process, wherein at least a main part of the housing design is made with an integral tubular cross section, and wherein in case two or more metal or ceramic housing parts are made with PIM technique and a wide gap between the housing parts occurs, the wide gap is compensated by an arrangement of compression ribs at the at least one additional element that can deform to adjust and fasten the distance between the assembled metal or ceramic parts.

3. A hearing aid comprising at least two metal or ceramic parts made using powder injection molding technique (PIM), wherein at least one additional element is arranged within the housing for placing functional parts to compensate any tolerances due to the PIM process, wherein at least a main part of the housing design comprises an integral tubular cross section, and wherein the hearing aid comprises an arrangement of compression ribs that are deformed to compensate for a gap between the assembled metal or ceramic parts.

4. A process according to claim 1, wherein electronic components are placed within the housing, using a frame made out of a polymeric material.

5. A process according to claim 1, wherein supplement parts, are carried by the additional element and/or a further additional element made of a polymeric material.

6. A process according to claim 1, wherein for assembling the hearing aid, fastening elements are used together with respective counterparts for fixation of the fastening elements, wherein the counterparts are made out of a polymeric material.

7. A process according to claim 1, wherein in case of the use of a metal injection molded part a non-conductive lacquer (coating or another non-conductive encapsulation part) is applied to the metal injection molded part to ensure separation from electronic components.

8. A process according to claim 1, wherein the hearing aid includes a battery door comprising a ceramic or metal cover and a counterpart made of a polymer material, being integrated in the battery door for holding a battery, the counterpart being connected to the PIM made ceramic or metal cover by a fastening element, snap-fit, adhesive bonding, welding or press-fit.

9. A process according to claim 1, wherein in case polymeric parts are connected to metal or ceramic parts, the connection is achieved by adhesive bonding, the adhesive bonding can also be used to seal already connected parts.

10. A process according to claim 1, wherein the at least one additional element is designed with an integral hinge or spring characteristic to be used as an elastic structure and to compensate a larger tolerance range with metal or ceramic parts.

11. A process according to claim 1, wherein the at least two ceramic or metal parts are coated with a hydrophobic coating.

12. A process according to claim 1, wherein a microphone protection and/or sound port are directly integrated into a ceramic or metal housing part by means of laser or conventional milling and drilling.

13. A process according to claim 1, wherein the housing is labelled or serialized with means of a laser engraving process.

14. A process according to claim 9, wherein the PIM part is subjected to a laser treatment prior to a bonding process in order to increase surface roughness.

15. A hearing aid according to claim 3, wherein the at least two metal or ceramic parts are relatively movable against each other.

16. A hearing aid according to one of the claim 3 or 15, wherein the additional element is made out of a polymeric material.

17. A hearing aid according to claim 3, wherein electronic components are arranged in a separate frame made of a polymeric material.

* * * * *